US009169621B2

(12) United States Patent
Masuda et al.

(10) Patent No.: US 9,169,621 B2
(45) Date of Patent: Oct. 27, 2015

(54) HYDRAULIC TUBING SUPPORT STRUCTURE AND OPERATING MACHINE PROVIDED THEREWITH

(75) Inventors: Kyoko Masuda, Kobe (JP); Masashi Kawabata, Kobe (JP); Yoshimune Mori, Kobe (JP); Yasumasa Kimura, Kobe (JP); Kazuhiro Ueda, Hiroshima (JP); Shuichi Ono, Hiroshima (JP)

(73) Assignees: KABUSHIKI KAISHA KOBE SEIKO SHO, Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 549 days.

(21) Appl. No.: 13/583,778

(22) PCT Filed: Mar. 3, 2011

(86) PCT No.: PCT/JP2011/001272

§ 371 (c)(1),
(2), (4) Date: Sep. 10, 2012

(87) PCT Pub. No.: WO2011/111347

PCT Pub. Date: Sep. 15, 2011

(65) Prior Publication Data

US 2013/0067901 A1 Mar. 21, 2013

(30) Foreign Application Priority Data

Mar. 9, 2010 (JP) ..... 2010-052159

(51) Int. Cl.
*E02F 9/22* (2006.01)
*E02F 9/16* (2006.01)
(Continued)

(52) U.S. Cl.
CPC ..... *E02F 9/16* (2013.01); *E02F 9/0875* (2013.01); *E02F 9/2004* (2013.01); *E02F 9/2275* (2013.01)

(58) Field of Classification Search
CPC ..... E02F 9/16; E02F 9/0875; E02F 9/2004; E02F 9/2267; E02F 9/2275; F15B 2211/6355
See application file for complete search history.

(56) References Cited

U.S. PATENT DOCUMENTS 6,450,278 B1 * 9/2002 Shirogami et al. ..... 180/69.21
6,550,571 B1 * 4/2003 Kimura et al. ..... 181/200
(Continued)

FOREIGN PATENT DOCUMENTS

| | | | |
|---|---|---|---|
| CN | 1704534 A | | 12/2005 |
| JP | 7 42810 | | 8/1995 |
| JP | 2004 116033 | | 4/2004 |
| JP | 2007 262690 | | 10/2007 |
| WO | WO2008129905 | * | 10/2008 |

OTHER PUBLICATIONS

JP2007262690A—Machine translation from Japanese to English from JP office. Oct. 2007.*
(Continued)

*Primary Examiner* — Edward Look
*Assistant Examiner* — Michael Quandt
(74) *Attorney, Agent, or Firm* — Oblon, McClelland, Maier & Neustadt, L.L.P.

(57) ABSTRACT

A hydraulic tubing support that reduces noise transmitted to an operator due to pulsation of hydraulic oil in a junction tube. The hydraulic tubing support structure includes a pair of left and right remote control valves for generating pilot pressures for the plurality of hydraulic actuators in response to an input operation performed on each operating lever, pump-side tubes and tank-side tubes respectively extending from the respective remote control valves, a junction tube for allowing communication of the tubes guided to below a floor plate through a through hole and communication of the tubes guided to below the floor plate through a through hole, and a middle reinforcement beam extending in a right-and-left direction and fixed to the lower surface of the floor plate. The junction tube is fixed to the middle reinforcement beam in a non-contact state with the floor plate.

9 Claims, 9 Drawing Sheets

(51) Int. Cl.
*E02F 9/08* (2006.01)
*E02F 9/20* (2006.01)

(56) References Cited

U.S. PATENT DOCUMENTS

| | | | | |
|---|---|---|---|---|
| 8,152,225 | B2 * | 4/2012 | Kamimae et al. | 296/190.08 |
| 2009/0243338 | A1 * | 10/2009 | Ueda et al. | 296/190.01 |

OTHER PUBLICATIONS

International Preliminary Report on Patentability issued Oct. 11, 2012 in PCT/JP2011/001272 filed Mar. 3, 2011.
Written Opinion issued Jun. 7, 2011 in PCT/JP2011/001272 filed Mar. 3, 2011.
International Search Report Issued Jun. 7, 2011 in PCT/JP11/001272 Filed Mar. 3, 2011.

* cited by examiner

HYDRAULIC TUBING SUPPORT STRUCTURE AND OPERATING MACHINE PROVIDED THEREWITH

TECHNICAL FIELD

The present invention relates to an operating machine including a plurality of hydraulic actuators.

BACKGROUND ART

Conventionally, a hydraulic shovel disclosed, for example, in patent literature 1 has been known as the above operating machine. The hydraulic shovel disclosed in patent literature 1 includes a driver's seat provided on a floor plate, a pair of operating levers provided at both left and right sides of the driver's seat, a pair of left and right remote control valves for producing pilot pressures for a plurality of hydraulic actuators in response to input operations performed on these operating levers, pump-side tubes and tank-side tubes extending from these remote control valves, and a junction tube for allowing communication of the pump-side tubes extending from the respective remote control valves and communication of the tank-side tubes extending from the respective remote control valves.

In the hydraulic shovel of patent literature 1, the junction tube connected to each remote control valve is connected to a hydraulic pump and a tank. Further, the junction tube is fixed to the lower surface of the floor plate.

However, since the junction tube is fixed to the lower surface of the floor plate in the hydraulic shovel of patent literature 1, there has been a problem that pulsation of hydraulic oil flowing in the junction tube is transmitted as vibration to the floor plate and becomes noise to an operator sitting on the driver's seat provided on the floor plate.

CITATION LIST

Patent Literature

Patent literature 1: Japanese Unexamined Patent Publication No. 2007-262690

SUMMARY OF INVENTION

An object of the present invention is to provide a tubing support structure capable of reducing noise transmitted to an operator due to pulsation of hydraulic oil in a junction tube and an operating machine provided therewith.

To solve the above problem, a hydraulic tubing support structure in an operating machine including a plurality of hydraulic actuators, to be provided by the present invention, includes a floor plate formed with a pair of left and right vertically penetrating through holes; a driver's seat provided on the floor plate; a pair of operating levers provided at both left and right sides of the driver's seat; a pair of left and right operation valves for generating pilot pressures for the plurality of hydraulic actuators in response to an input operation performed on each operating lever; a pair of left and right pump-side tubes respectively extending from the respective operation valves and guided to below the floor plate through the through holes; a pair of left and right tank-side tubes respectively extending from the respective operation valves and guided to below the floor plate through the through holes; a junction tube for allowing communication of the respective pump-side tubes guided to below the floor plate through the through holes and communication of the respective tank-side tubes guided to below the floor plate through the through holes; and a first reinforcement beam extending in a right-and-left direction and fixed to the lower surface of the floor plate, wherein the junction tube is fixed to the first reinforcement beam in a non-contact state with the floor plate.

An operating machine to be provided by the present invention comprises the hydraulic tubing support structure; a hydraulic pump and a tank to be connected to the junction tube.

According to the present invention, it is possible to reduce noise transmitted to an operator due to pulsation of hydraulic oil in the junction tube.

EMBODIMENT OF INVENTION

Hereinafter, an embodiment of the present invention is described with reference to the accompanying drawings. Note that the following embodiment is a specific example of the present invention and is not of the nature to limit the technical scope of the present invention.

Figure 1:
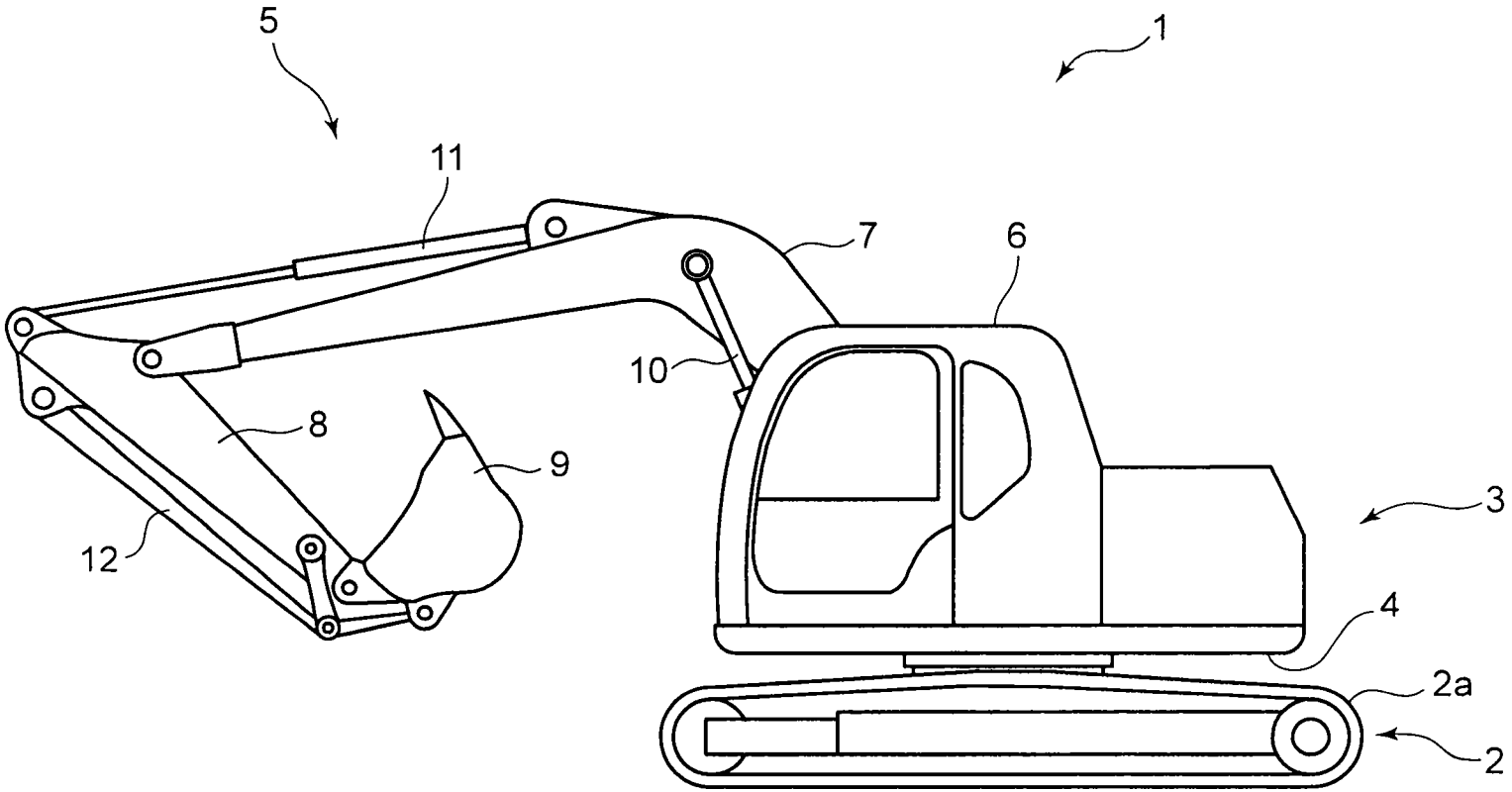
FIG. 1 is a side view showing the overall configuration of a hydraulic shovel according to an embodiment of the present invention.

FIG. 1 is a side view showing the overall configuration of a hydraulic shovel according to the embodiment of the present invention. Note that the following description is based on an up-and-down direction and a right-and-left direction viewed from a passenger in a cabin 6 of FIG. 1.

Figure 6:
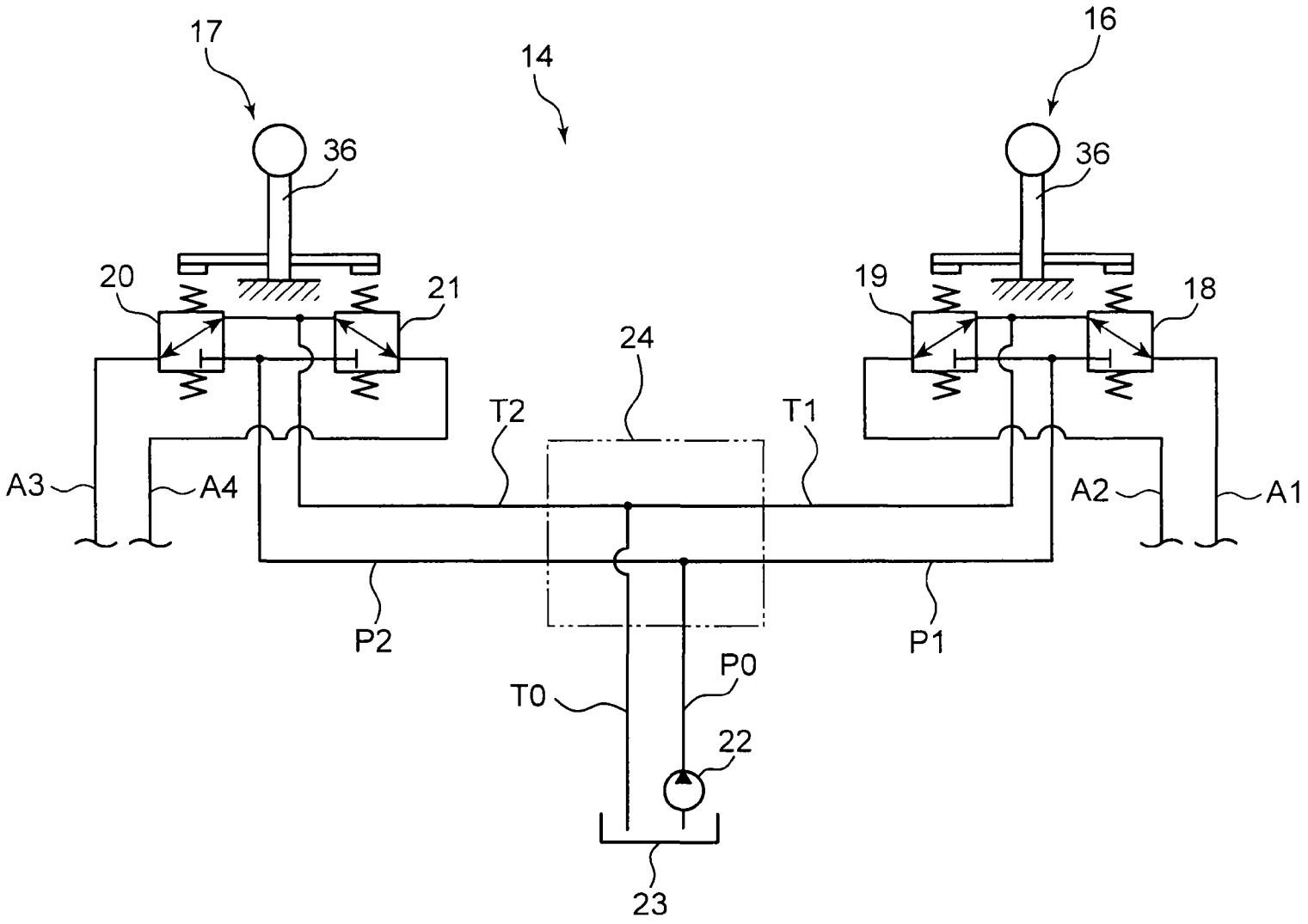
FIG. 6 is a circuit diagram showing a part of a hydraulic system provided in the hydraulic shovel of FIG. 1.

With reference to FIG. 1, a hydraulic shovel 1 as an example of an operating machine includes a lower propelling body 2 with a crawler 2*a*, an upper slewing body 3 rotatably provided on this base carrier 2, an operating attachment 5 and the cabin 6 provided on a slewing frame 4 of this upper slewing body 3, and a hydraulic system 14 (see FIG. 6).

The operation attachment 5 includes a boom 7 provided to be raised and lowered about a horizontal axis relative to the slewing frame 4, an arm 8 provided pivotably about a horizontal axis relative to a distal end part of this boom 7 and a bucket 9 mounted rotatably about a horizontal axis relative to a distal end part of this arm 8. The boom 7 is raised and lowered according to extension and contraction of a boom cylinder 10. The arm 8 pivots relative to the boom 7 according to extension and contraction of an arm cylinder 11. The bucket 9 rotates relative to the arm 8 according to extension and contraction of a bucket cylinder 12.

Figure 2:
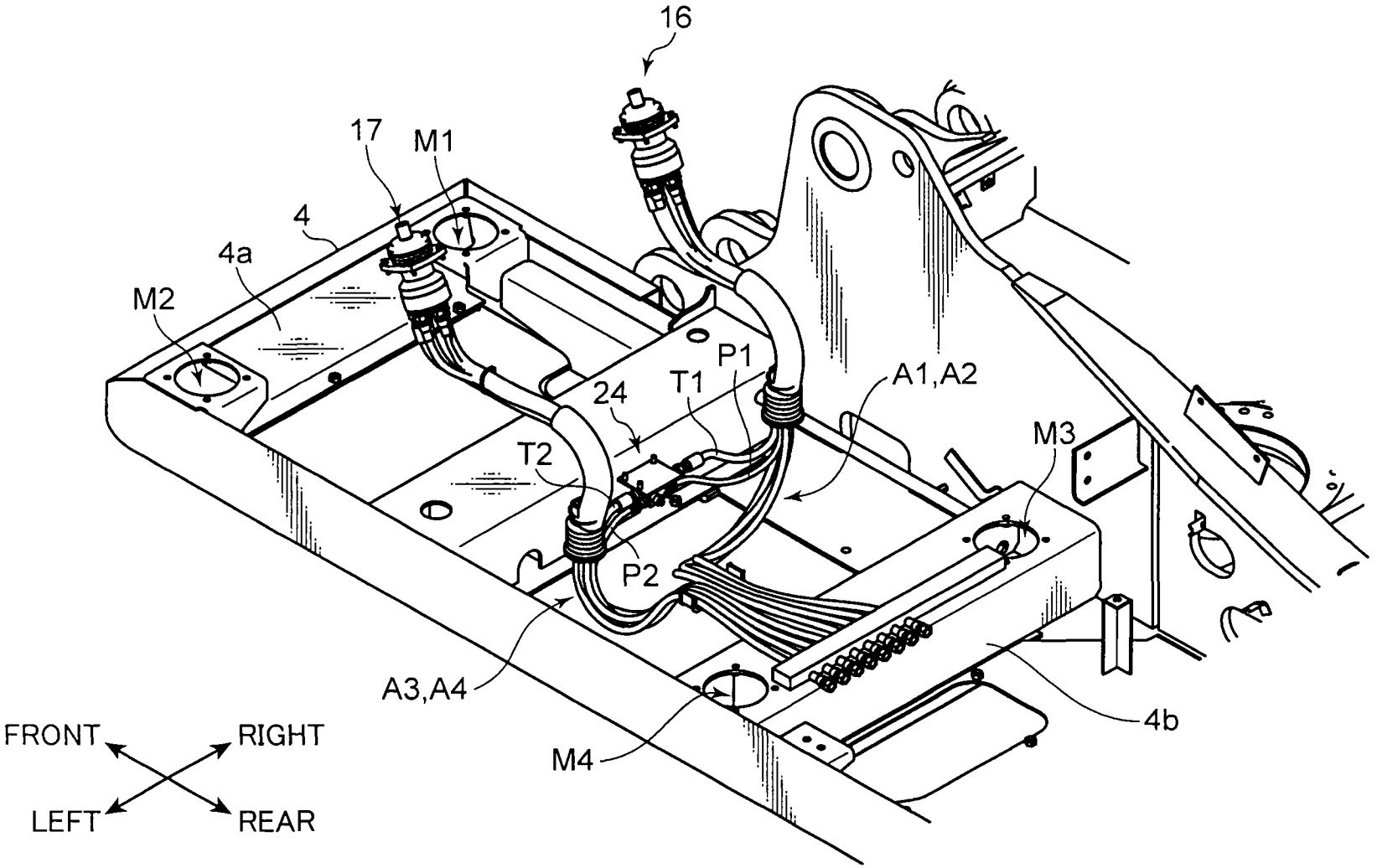
FIG. 2 is a perspective view enlargedly showing a part of a slewing frame of the hydraulic shovel of FIG. 1.

FIG. 2 is a perspective view enlargedly showing a part of the slewing frame of the hydraulic shovel of FIG. 1.

With reference to FIG. 2, a part for mounting the cabin 6 on the floor plate is provided at a front-left position on the slewing frame 4. Specifically, a pair of front and rear bases 4*a*, 4*b* extending in the right-and-left direction stand on the slewing frame 4. These bases 4*a*, 4*b* have the same right-and-left length, and mount mounting portions M1 to M4 used to mount a mount (not shown) for supporting a floor plate 15 (see FIG. 3) in a vibration-proof manner are provided on left and right end parts of the respective bases 4*a*, 4*b*.

Figure 3:
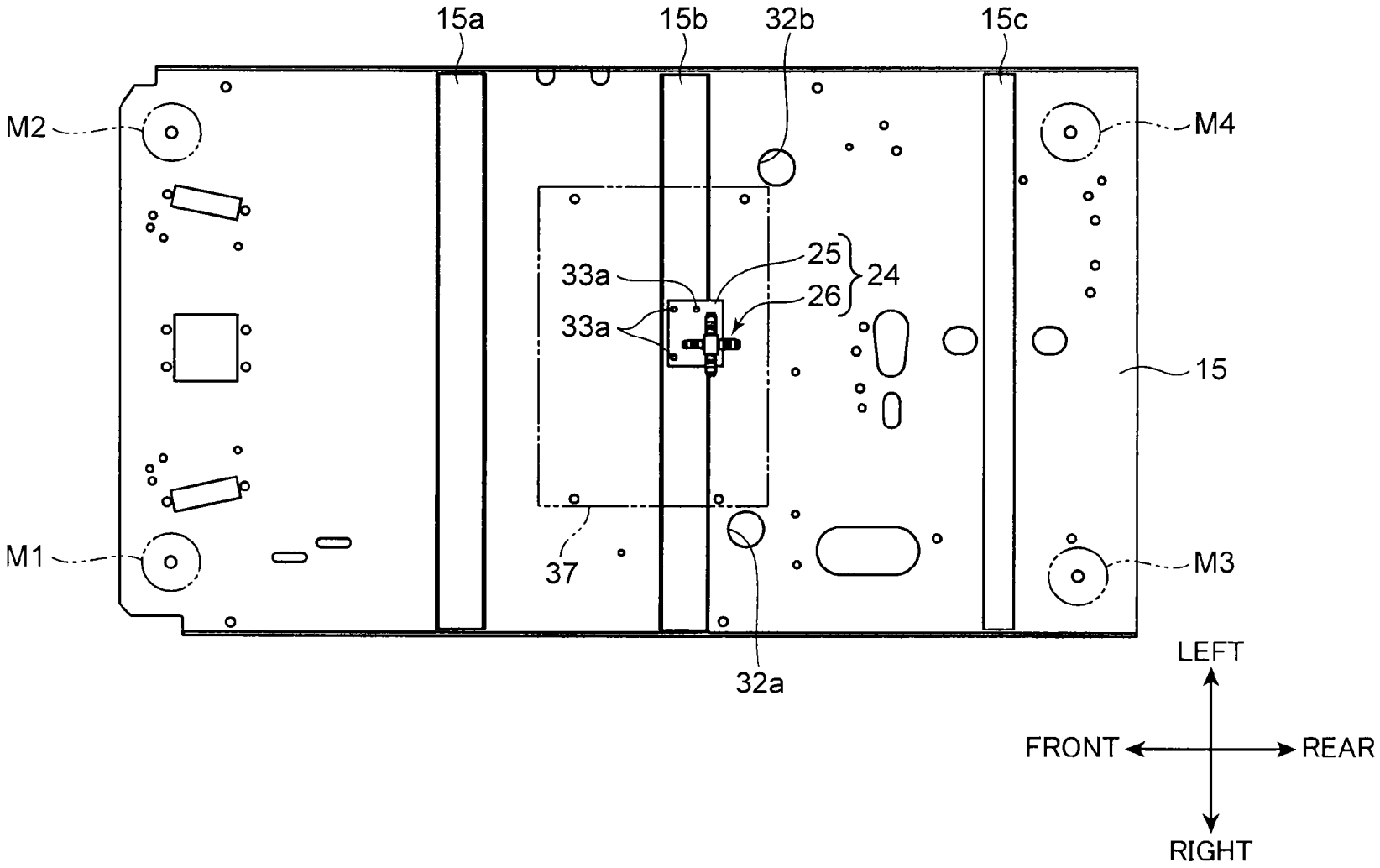
FIG. 3 is a bottom view of a floor plate provided on the slewing frame of FIG. 2.

FIG. 3 is a bottom view of the floor plate 15 provided on the slewing frame of FIG. 2.

With reference to FIG. 3, the floor plate 15 is made of a metal plate, the left and right edge parts of which are bent downwardly at an angle of 90° and which has a C-shaped front view and a substantially rectangular plan view. Four corners of this floor plate 15 are supported from blow by the mounts (mount mounting portions M1 to M4 are shown in FIG. 3) provided on the slewing frame. Further, the floor plate 15 is provided with a pair of left and right through holes 32*a* and 32*b* vertically penetrating to guide hydraulic tubes to be described later (tubes P1, P2, T1, T2, A1 to A4 of FIG. 2) to below the floor plate 15. The right through hole 32*a* is provided to the right of an arrangement position of a seat stand 37 (see FIG. 4) for holding a driver's seat 35 to be described later and next to a rear part of the arrangement position. The left through hole 32*b* is provided to the left of the arrangement position of the seat stand 37 and slightly projects backward from the arrangement position (more backward than the through hole 32*a*).

Further, a front reinforcement beam (second reinforcement beam) 15*a*, a middle reinforcement beam (first reinforcement beam) 15*b* and a rear reinforcement beam (third reinforcement beam) 15*c* respectively extending in the right-and-left direction are fixed to the floor plate 15. The front reinforcement beam 15*a* is provided before the seat stand 37. The middle reinforcement beam 15*b* is provided at a position overlapping a range where the seat stand 37 is supported (range where the driver's seat is supported) when viewed from above. The rear reinforcement beam 15*c* is provided behind the seat stand 37.

The respective reinforcement beams 15*a* to 15*c* suppress vibration of the floor plate 15 utilizing the rigidity of these. Specifically, the front reinforcement beam 15*a* suppresses vibration of the floor plate 15 at the feet of an operator sitting on the driver's seat 35 (see FIG. 4) by being provided before the seat stand 37. In this way, the front reinforcement beam 15*a* contributes to a reduction in noise transmitted to the operator. The middle reinforcement beam 15*b* is provided at the position overlapping the range of the floor plate 15 where the driver's seat 35 is supported and which is weak (larger amplitude) against vibration due to the weight of the driver's seat 35. In this way, the middle reinforcement beam 15*b* contributes to an improvement in strength against vibration of the floor plate 15 by the rigidity of the middle reinforcement beam 15*b*. Further, the middle reinforcement beam 15*b* is provided below the seat stand 37, whereby vibration directly transmitted to the driver's seat 35 from the floor plate 15 is suppressed. In this way, the middle reinforcement beam 15*b* contributes to a reduction in noise transmitted to the operator. As shown in FIG. 5, the rear reinforcement beam 15*c* is provided at a position where vibration becomes particularly large on the floor plate 15 to which the middle reinforcement beam 15*b* is fixed. In this way, the rear reinforcement beam 15*c* more effectively suppresses vibration of the floor plate 15. FIG. 5 is a left side view of the floor plate 15 of FIG. 3 and a conceptual diagram showing the amplitude of a natural vibration mode of the floor plate 15 in a state where the rear reinforcement beam 15*c* is not provided. Note that a reference sign M0 denotes the mounts for supporting the floor plate 15. As shown in FIG. 5, the amplitude of the natural vibration mode is relatively small at the positions where the front reinforcement beam 15*a* and the middle reinforcement beam 15*b* are provided and in neighboring ranges before and after these positions. Contrary to this, the amplitude of the natural vibration mode becomes larger at a position near the mount M0 after the middle reinforcement beam 15*b*. Since the rear reinforcement beam 15*c* is provided at a position passing through a position Pk where the amplitude of the natural vibration mode becomes largest in this embodiment, vibration of the floor plate 15 can be effectively suppressed utilizing the rigidity of this rear reinforcement beam 15*c*.

Figure 8:
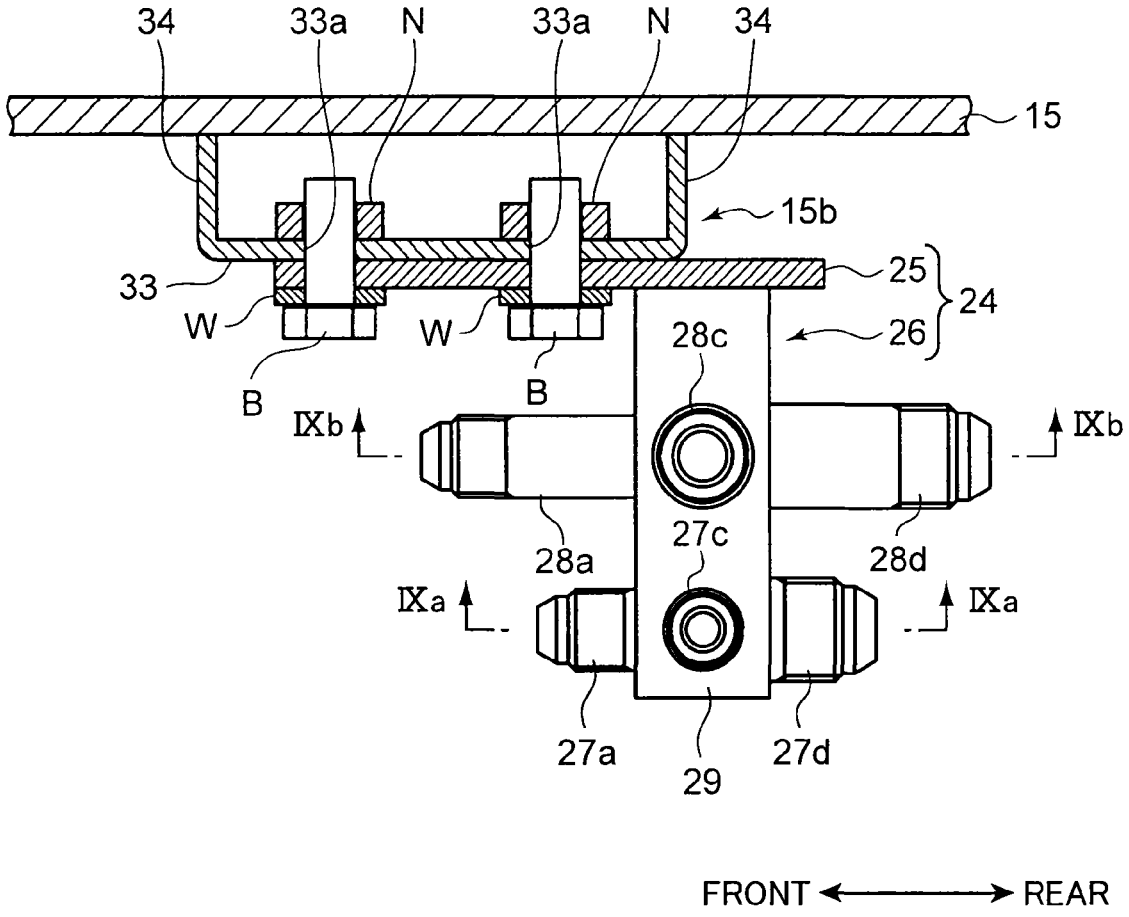
FIG. 8 is a sectional view along line VIII-VIII of FIG. 7.

Since the specific configurations of the respective reinforcement beams 15*a* to 15*c* are respectively similar, the middle reinforcement beam 15*b* is described as an example with reference to FIG. 8. The middle reinforcement beam 15*b* is made of a metal plate extending in the right-and-left direction. Specifically, the middle reinforcement beam 15*b* includes a main body portion 33 substantially parallel to the floor plate 15 and a pair of front and rear leg portions 34 formed by bending front and rear edge parts of this main body portion 33 upwardly at an angle of 90°. This middle reinforcement beam 15*b* is welded with upper end parts of the respective leg portions 34 held in contact with the lower surface of the floor plate 15 so that a clearance is formed between the main body portion 33 and the lower surface of the floor plate 15. Further, the middle reinforcement beam 15*b* includes three holes 33*a* (see FIG. 3) vertically penetrating through the main body portion 33 and three nuts N each with an internally threaded portion concentrically arranged with the corresponding hole 33*a*. These nuts N are fixed to the upper surface of the main body portion 33 such as by welding between the main body portion 33 and the floor plate 15. Note that the holes 33*a* and the nuts N are not provided in the front reinforcement beam 15*a* and the rear reinforcement beam 15*c*.

Figure 4:
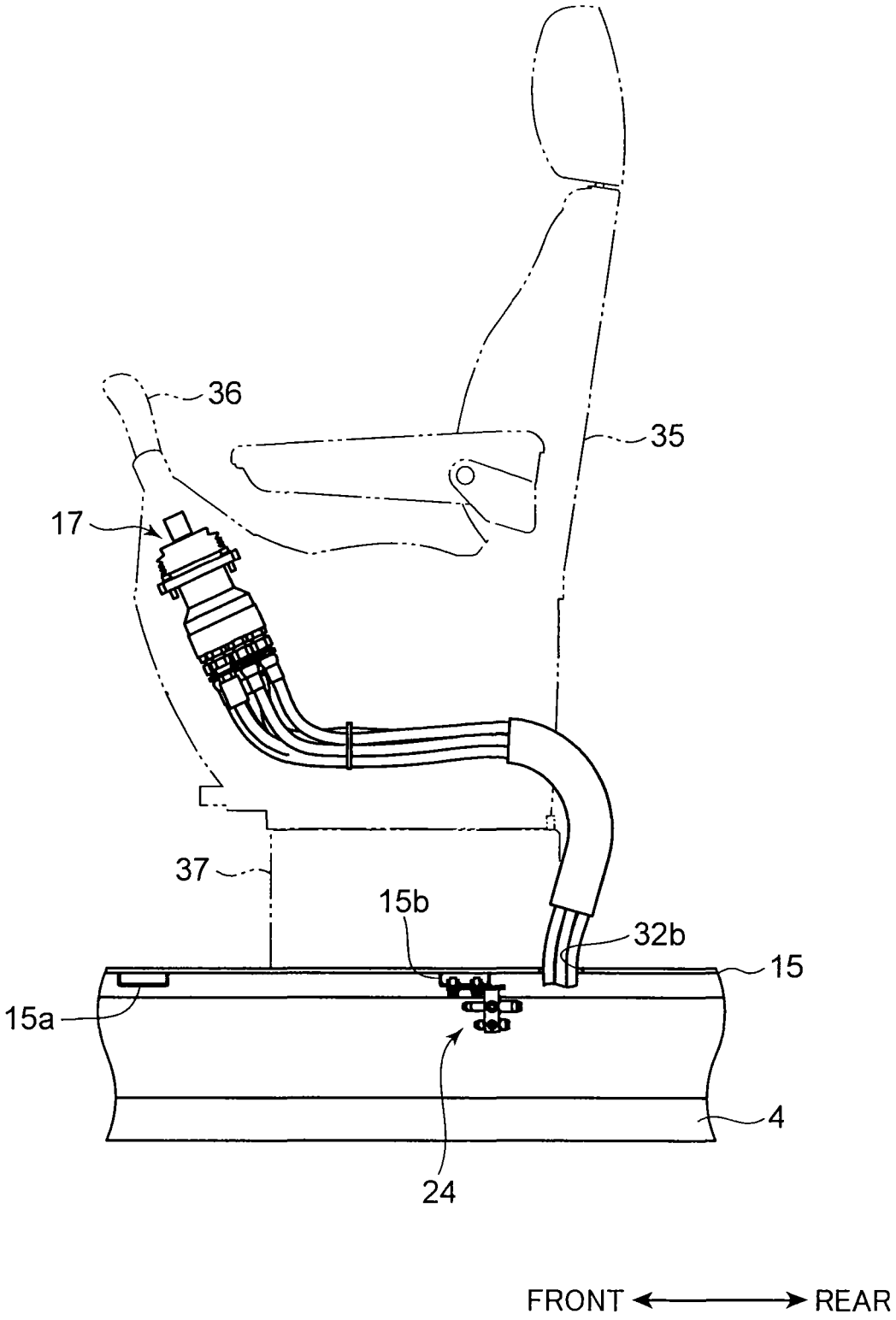
FIG. 4 is a left side view showing a driver's seat provided on the floor plate of FIG. 3.
Figure 5:
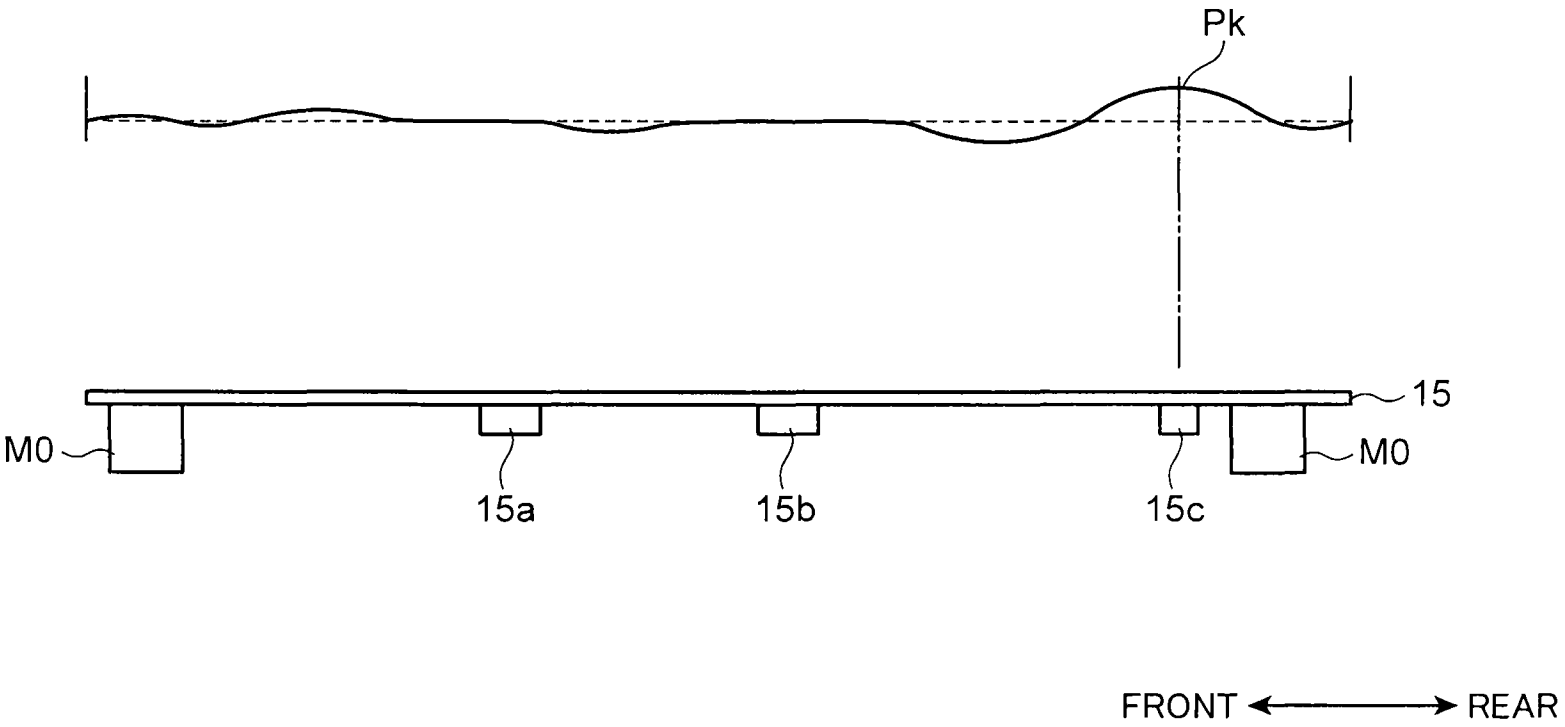
FIG. 5 is a conceptual diagram showing a left side view of the floor plate of FIG. 3 and the amplitude of a natural vibration mode of the floor plate in a state where a rear reinforcement beam is not provided.

FIG. 4 is a left side view showing the driver's seat provided on the floor plate 15 of FIG. 3.

With reference to FIGS. 3 and 4, the cabin 6 includes the seat stand (supporting member) 37 provided substantially at a central position of the floor plate 15 in the front-and-rear direction and the right-and-left direction, the driver's seat 35 provided on this seat stand 37, and operating levers 36 provided at both left and right sides of this driver's seat 35. The respective operating levers 36 adjust a pilot pressure via remote control valves 16, 17 to be described later. The seat stand 37 is in the form of a hollow box.

FIG. 6 is a circuit diagram showing a part of the hydraulic system provided in the hydraulic shovel of FIG. 1.

With reference to FIG. 6, the hydraulic system 14 supplies hydraulic oil discharged from a pilot pump 22 to pilot ports of hydraulic actuators such as the boom cylinder 10, the arm cylinder 11 and the bucket cylinder 12 via the remote control valves (operation valves) 16, 17. On the other hand, the hydraulic system collects the hydraulic oil led out from the pilot ports of the hydraulic actuators into a tank 23.

Specifically, the hydraulic system 14 includes a tube P0 connected to the pilot pump 22, tubes P1 and P2 branched off from this tube P0, the remote control valves 16, 17 connected to these tubes P1, P2, a tube T0 connected to the tank 23, tubes T1 and T2 branched off from this tube T0 and connected to the respective remote control valves 16, 17, a junction tube 24 allowing communication of the tubes P1, P2 with the tube P0 and communication of the tubes T1, T2 with the tube T0, tubes A1 and A2 connecting the remote control valve 16 and the pilot ports of the hydraulic actuators, and tubes A3 and A4 connecting the remote control valve 17 and the pilot ports of the hydraulic actuators.

The remote control valve 16 includes pilot valves 18 and 19. Further, the remote control valve 17 includes pilot valves 20 and 21. By inclining each operating lever 36, the opening of each pilot valve 18 to 21 is adjusted according to the direction and amount of inclination. In FIG. 6, two tubes (A1 and A2, A3 and A4) are shown as tubes connecting the operating lever 36 and the pilot ports of the hydraulic actuators for each operating lever 36. However, actually, a rotating operation and an arm bending operation are performed by the right operating lever 36 and a boom raising/lowering operation and a bucket pivoting operation are performed by the left operating lever 36. Thus, four tubes are actually provided as tubes connecting the operating lever 36 and the pilot ports of the hydraulic actuators for each operating lever 36. Further, four pilot valves are provided for each operating lever 36 in correspondence with the number of the tubes.

Figure 7:
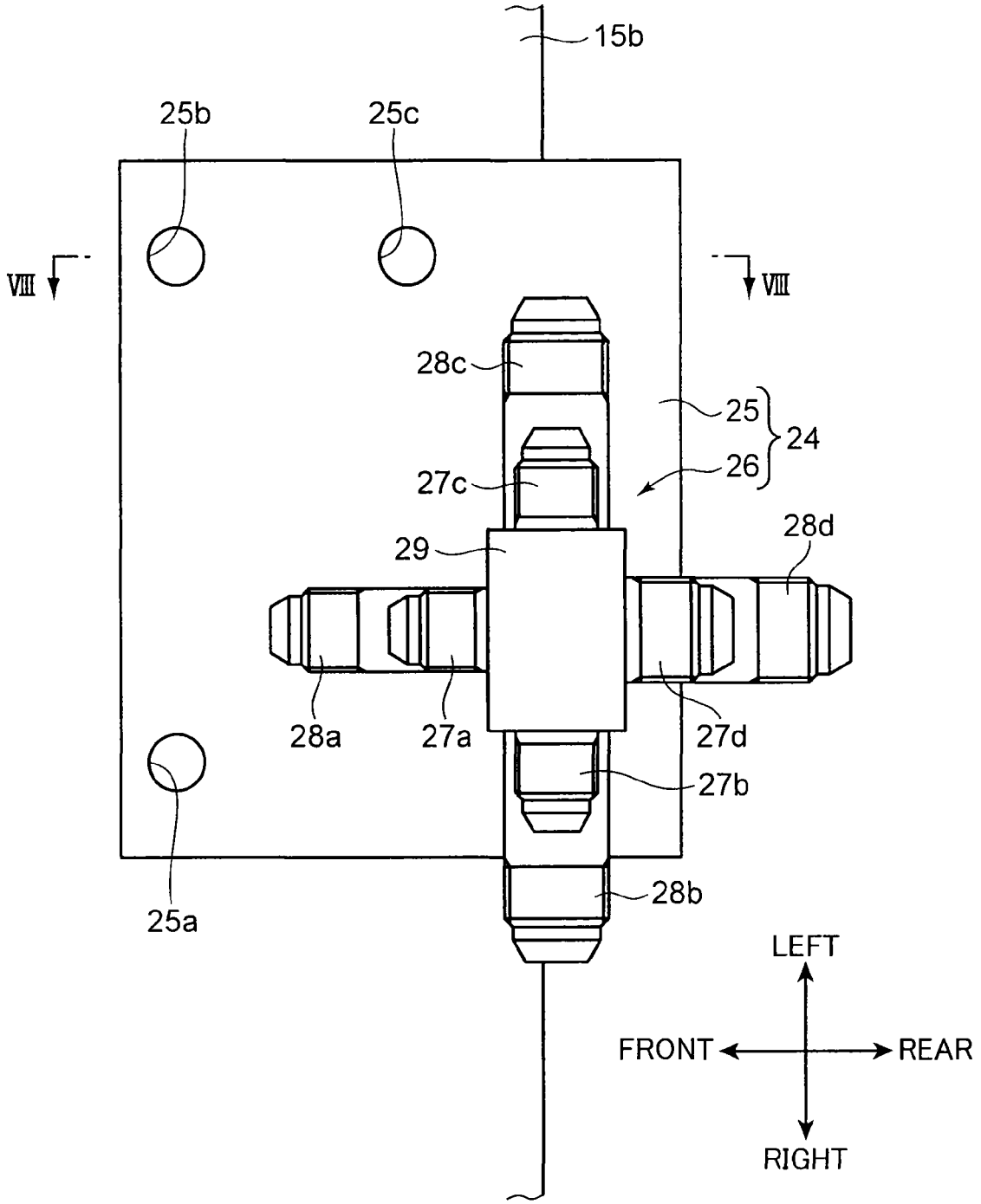
FIG. 7 is a bottom view showing the overall configuration of a junction tube of FIG. 6.
Figure 9B:
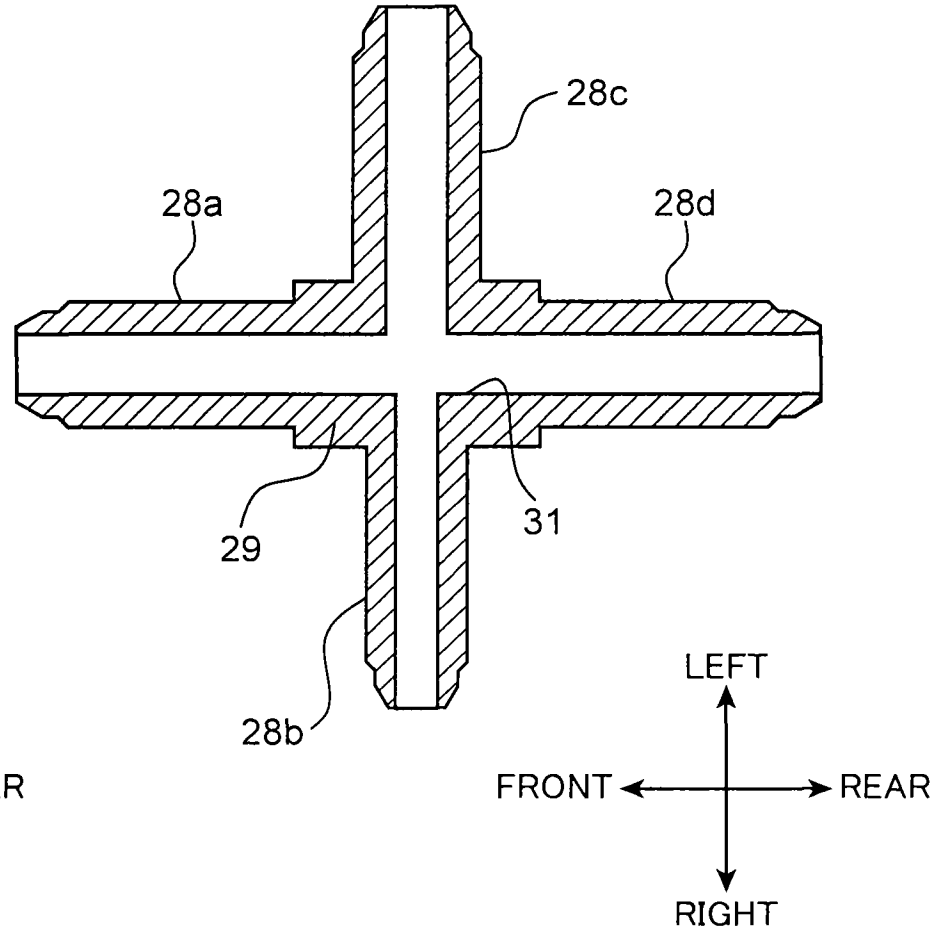
FIG. 9B is a sectional view along line IXb-IXb of FIG. 8.
Figure 9A:
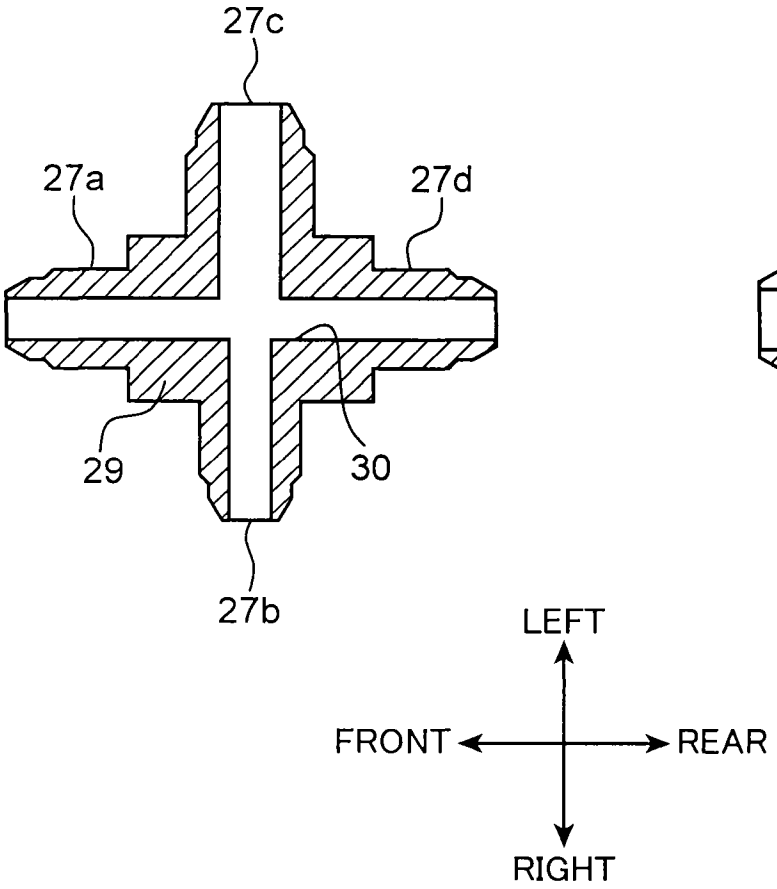
FIG. 9A is a sectional view along line IXa-IXa of FIG. 8

FIG. 7 is a bottom view showing the overall configuration of the junction tube 24 of FIG. 6. FIG. 8 is a sectional view along line VIII-VIII of FIG. 7. FIG. 9A is a sectional view along line IXa-IXa of FIG. 8, and FIG. 9B is a sectional view along line IXb-IXb of FIG. 8.

With reference to FIGS. 3 and 7 to 9, the junction tube 24 is fixed to the lower surface of the main body portion 33 of the middle reinforcement beam 15*b* at a substantially central position of the middle reinforcement beam 15*b* in the right-and-left direction in a non-contact state with the floor plate 15. Specifically, the junction tube 24 includes a base plate 25 to be fixed to the main body portion 33 of the middle reinforcement beam 15*b* and a tube main body 26 provided on the lower surface of this base plate 25. The base plate 25 is made of a substantially rectangular metal plate. This base plate 25 is provided with a pair of insertion holes 25*a*, 25*b* arranged in the right-and-left direction to each other in a front part of the base plate 25, and an insertion hole 25*c* provided behind the insertion hole 25*b*, the insertion holes 25*a* to 25*c* vertically penetrating through the base plate 25. These insertion holes 25*a* to 25*c* are provided at positions corresponding to the holes 33*a* of the middle reinforcement beam 15*b* and sized to enable insertion of bolts B. The tube main body 26 includes a supporting column portion 29 standing on the base plate 25, pump-side connecting portions 27*a* to 27*b* respectively projecting forward, rightward, leftward and backward on the same plane from this supporting column portion 29, and tank-side connecting portions 28*a* to 28*d* respectively projecting forward, rightward, leftward and backward on the same plane from this supporting column portion 29 at positions above these pump-side connecting portions 27*a* to 27*d*. As shown in FIG. 8, by threadably engaging three bolts B inserted from below with the respective nuts N with washers W sandwiched, the junction tube 24 is fixed to the lower surface of the middle reinforcement beam 15*b* (main body portion 33). In this state, the pump-side connecting portions 27*b*, 27*c* and the tank-side connecting portions 28*b*, 28*c* are arranged to face an opposite direction of the right-and-left direction at positions where they slightly project backward from the middle reinforcement beam 15*b*. Specifically, the pump-side connecting portion 27*b* and the tank-side connecting portion 28*b* for connecting the tubes T1, P1 passing through the right through hole 32*a* are provided on the tube main body 26 (supporting column portion 29) to face rightward. On the other hand, the pump-side connecting portion 27*c* and the tank-side connecting portion 28*c* for connecting the tubes T2, P2 passing through the left through hole 32*b* are provided on the tube main body 26 (supporting column portion 29) to face leftward. Further, the pump-side connecting portion 27*d* and the tank-side connecting portion 28*d* are arranged to face backward at a position behind the middle reinforcement beam 15*b*. Specifically, the pump-side connecting portion 27*d* and the tank-side connecting portion 28*d* to be connected to the hydraulic pump and the tank arranged behind the tube main body 26 are provided on the tube main body 26 (supporting column portion 29) to face backward.

The tube P0 is connected to the pump-side connecting portion 27*d*, the tube P1 is connected to the pump-side connecting portion 27*b*, and the tube P2 is connected to the pump-side connecting portion 27*c*. The respective tubes P0 to P2 communicate with each other via a communication passage 30 (see FIG. 9A) linking the interiors of the respective pump-side connecting portions 27*a* to 27*d*. On the other hand, the tube T0 is connected to the tank-side connecting portion 28*d*, the tube T1 is connected to the tank-side connecting portion 28*b*, and the tube T2 is connected to the tank-side connecting portion 28*c*. The respective tubes T0 to T2 communicate with each other via a communication passage 31 (see FIG. 9B) linking the interiors of the respective tank-side connecting portions 28*a* to 28*d*. Note that, in this embodiment, the pump-side connecting portion 27*a* and the tank-side connecting portion 28*a* on the front side are closed by blank plugs.

An arrangement mode of the hydraulic tubing is described below with reference to FIGS. 2 to 4 and 8.

The tubes P1, T1, A1 and A2 connected to the remote control valve 16 provided at the right side of the driver's seat 35 are guided to below the floor plate 15 through the through hole 32*a* formed in the floor plate 15. The tube P1 is connected to the pump-side connecting portion 27*b* of the junction tube 24. Further, the tube T1 is connected to the tank-side connecting portion 28*b* of the junction tube 24. The remaining tubes A1, A2 are guided to behind the cabin 6 as shown in FIG. 2.

On the other hand, the tubes P2, T2, A3 and A4 connected to the remote control valve 17 provided at the left side of the driver's seat 35 are guided to below the floor plate 15 through the through hole 32*b* formed in the floor plate 15. The tube P2 is connected to the pump-side connecting portion 27*c* of the junction tube 24. Further, the tube T2 is connected to the tank-side connecting portion 28*c* of the junction tube 24. The remaining tubes A3, A4 are guided to behind the cabin 6 as shown in FIG. 2.

The pump-side connecting portion 27*d* communicating with the pump-side connecting portions 27*b*, 27*c* is connected to the pilot pump 22 (see FIG. 6) arranged behind the cabin 6 via the tube P0. Further, the tank-side connecting portion 28*d* communicating with the tank-side connecting portions 28*b*, 28*c* is connected to the tank 23 (see FIG. 6) arranged behind the cabin 6 via the tube T0.

In such an arrangement mode of the hydraulic tubing, the junction tube 24 for allowing communication of the respective tubes P1, P2, T1 and T2 is fixed to the middle reinforcement beam 15*b* in this embodiment. Thus, vibration of the floor plate 15 can be suppressed by the rigidity of the middle reinforcement beam 15*b*. Further, by providing the middle reinforcement beam 15*b* between the junction tube 24 and the floor plate 15, vibration transmitted from the junction tube 24 to the floor plate 15 can be alleviated.

Note that, in this embodiment, the pump-side connecting portions 27*b*, 27*c* and the tank-side connecting portions 28*b*, 28*c* are respectively arranged to face outward in the right-and-left direction at the positions projecting backward from the middle reinforcement beam 15*b* as shown in FIGS. 3 and 7. Thus, necessary lengths of the tubes P1, P2, T1 and T2 to be connected to these connecting portions 27*b*, 27*c*, 28*b* and 28*c* can be shortened. Further, the pump-side connecting portion 27*d* to be connected to the pilot pump 22 and the tank-side connecting portion 28*d* to be connected to the tank 23 are arranged to face backward. Thus, necessary lengths of the tubes P0, T0 (see FIG. 6) from the pilot pump 22 and the tank 23 located behind the cabin 6 to the junction tube 24 can be shortened.

As described above, according to this embodiment, the junction tube 24 is fixed to the middle reinforcement beam 15*b* fixed to the lower surface of the floor plate 15 in a non-contact state with the floor plate 15. Thus, noise transmitted to the operator due to pulsation of the hydraulic oil in this junction tube 24 can be suppressed. Specifically, since the middle reinforcement beam 15*b* extending in the right-and-left direction is provided in this embodiment, vibration of the floor plate 15 can be suppressed by the rigidity of the middle reinforcement beam 15*b*. In addition, since the junction tube 24 is indirectly fixed to the floor plate 15 via the middle reinforcement beam 15*b*, vibration transmitted from the junction tube 24 to the floor plate 15 can be reduced. Thus, according to this embodiment, not only vibration transmitted from the junction tube 24 to the floor plate 15 can be alleviated by the middle reinforcement beam 15*b*, but also vibration of the floor plate 15 can be suppressed by the rigidity of the middle reinforcement beam 15*b* even if vibration is transmitted from the junction tube 24 to the floor plate 15. Therefore, noise transmitted to the operator due to pulsation of the hydraulic oil in this junction tube 24 can be suppressed.

In the above embodiment, the middle reinforcement beam 15*b* is provided at the position overlapping the range of the floor plate 15 where the driver's seat 35 (seat stand 37) is supported when viewed from above. According to this embodiment, noise transmitted to the operator can be effectively reduced while the floor plate 15 is effectively reinforced. Specifically, vibration of a relatively low frequency (hereinafter, referred to as low-frequency vibration) actually felt as a movement of the floor plate 15 by the operator and vibration of a relatively high frequency (hereinafter, referred to as high-frequency vibration) felt as noise by the operator are present as vibration produced in the floor plate 15. Here, if a heavy load such as the driver's seat 35 is provided on the floor plate 15, the amplitude of the low-frequency vibration becomes larger and a movement felt by the operator becomes larger due to the weight of the driver's seat 35 (including the seat stand 37). Contrary to this, low-frequency vibration produced in the floor plate 15 can be reduced by the rigidity of the middle reinforcement beam 15*b* by arranging the middle reinforcement beam 15*b* to overlap the range where the driver's seat 35 is supported as in the above embodiment. Further, in the above embodiment, the junction tube 24 that can serve as a generation source of the high-frequency vibration is provided on the middle reinforcement beam 15*b* arranged at the position overlapping the position where the driver's seat 35 is supported as described above. Thus, the high-frequency vibration from the junction tube 24 can be reduced by the weight of the driver's seat 35. Therefore, according to the above embodiment, noise transmitted to the operator can be effectively reduced by reducing high-frequency vibration while low-frequency vibration is reduced and the floor plate 15 is effectively reinforced.

Further, in the above embodiment, the seat stand 37 provided above the junction tube 24 is in the form of a hollow box. Thus, high-frequency vibration from the junction tube 24 can be trapped in the interior space of the seat stand 37. This can suppress the transmission of the high-frequency vibration as noise to the operator.

Furthermore, as shown in FIG. 3, the respective through holes 32*a*, 32*b* are formed at the positions in alignment with the seat stand 37 in the right-and-left direction or formed behind the seat stand 37 and the front reinforcement beam 15*a* extends in the right-and-left direction before the seat stand 37 in the above embodiment. According to this embodiment, by providing the front reinforcement beam 15*a* before the seat stand 37 (driver's seat 35), vibration of the floor plate 15 can be suppressed not only in the range below the seat stand 37, but also at the front side of the seat stand 37 (driver's seat 35), i.e. on the feet of the operator. Thus, noise transmitted to the operator can be more effectively reduced. In addition, the junction tube 24 is fixed to the middle reinforcement beam 15*b* provided behind the front reinforcement beam 15*a* and closer to the respective through holes 32*a*, 32*b*. Thus, as compared with the case where the junction tube 24 is fixed to the front reinforcement beam 15*a*, the pump-side tubes P1, P2 and the tank-side tubes T1, T2 extending from the junction tube 24 to be connected the respective remote control valves 16, 17 via the respective through holes 32*a*, 32*b* can be shortened. Therefore, according to the above embodiment, noise transmitted to the operator can be effectively reduced while the tubes P1, P2, T1 and T2 are shortened.

In the above embodiment, the middle reinforcement beam 15*b* includes the main body portion 33 and the pair of front and rear leg portions 34, the upper end parts of the respective leg portions 34 are welded in contact with the lower surface of the floor plate 15 to form the clearance between the main body portion 33 and the floor plate 15, and the main body portion 33 includes the nuts N. According to this embodiment, the junction tube 24 can be fixed by the bolts B to the middle reinforcement beam 15*b* fixed to the floor plate 15 by welding. Thus, the junction tube 24 can be fixed without specially working the floor plate 15.

In the above embodiment, as shown in FIG. 5, the rear reinforcement beam 15*c* is provided in a part Pk where the amplitude is largest in the natural vibration mode of the floor plate 15 to which the middle reinforcement beam 15*b* is fixed. Thus, vibration produced in the floor plate 15 can be more effectively reduced by the rigidity of this rear reinforcement beam 15*c*.

In the above embodiment, on the tube main body 26 (supporting column portion 29) arranged between the pair of left and right through holes 32*a*, 32*b*, the connecting portions 27*b*, 28*b* to be connected to the tubes P1, T1 passing through the through hole 32*a* are provided to face rightward and the connecting portions 27*c*, 28*c* to be connected to the tubes P2, T2 passing through the through hole 32*b* are provided to face leftward. This enables distances from the through holes 32*a*, 32*b* to the connecting portions 27*b*, 27*c*, 28*b* and 28*c* to be shortened. Thus, the respective tubes P1, P2, T1 and T2 can be shortened.

In the above embodiment, the connecting portions 27*d*, 28*d* are provided on the tube main body 26 (supporting column portion 29) to face rearward. This enables distances from the pilot pump 22 and the tank 23 provided behind the tube main body 26 to the connecting portions 27*d*, 28*d* to be shortened. Thus, the tubes P0, T0 connecting the pilot pump 22 and the tank 23 to the junction tube 24 can be shortened.

Note that the specific embodiment described above mainly includes inventions having the following configurations.

To solve the above problem, a hydraulic tubing support structure in an operating machine including a plurality of hydraulic actuators, to be provided by the present invention, includes a floor plate formed with a pair of left and right vertically penetrating through holes, a driver's seat provided on the floor plate, a pair of operating levers provided at both left and right sides of the driver's seat, a pair of left and right operation valves for generating pilot pressures for the plurality of hydraulic actuators in response to an input operation performed on each operating lever, a pair of left and right pump-side tubes respectively extending from the respective operation valves and guided to below the floor plate through the through holes, a pair of left and right tank-side tubes respectively extending from the respective operation valves and guided to below the floor plate through the through holes, a junction tube for allowing communication of the respective pump-side tubes guided to below the floor plate through the through holes and communication of the respective tank-side tubes guided to below the floor plate through the through holes, and a first reinforcement beam extending in a right-and-left direction and fixed to the lower surface of the floor plate, wherein the junction tube is fixed to the first reinforcement beam in a non-contact state with the floor plate.

In the present invention, the junction tube is fixed to the first reinforcement beam fixed to the lower surface of the floor plate in the non-contact state with the floor plate. Thus, noise transmitted to an operator due to pulsation of hydraulic oil in the junction tube can be suppressed. Specifically, since the first reinforcement beam extending in the right-and-left direction is provided in the present invention, vibration of the floor plate can be suppressed by the rigidity of the first reinforcement beam. In addition, since the junction tube is indirectly fixed to the floor plate via the first reinforcement beam, vibration transmitted from the junction tube to the floor plate can be reduced. Thus, according to the present invention, not only vibration transmitted from the junction tube to the floor plate can be alleviated by the first reinforcement beam, but also vibration of the floor plate can be suppressed by the rigidity of the first reinforcement beam even if vibration is transmitted from the junction tube to the floor plate. Thus, noise transmitted to the operator due to pulsation of hydraulic oil in the junction tube can be suppressed.

In the above hydraulic tubing support structure, at least a part of the first reinforcement beam is preferably provided at a position overlapping a range of the floor plate where the driver's seat is supported when viewed from above.

In this aspect, noise transmitted to the operator can also be effectively reduced while the floor plate is effectively reinforced. Specifically, vibration of a relatively low frequency (hereinafter, referred to as low-frequency vibration) actually felt as a movement of the floor plate by the operator and vibration of a relatively high frequency (hereinafter, referred to as high-frequency vibration) felt as noise by the operator are present as vibration produced in the floor plate. Here, if a heavy load such as the driver's seat is provided on the floor plate, the amplitude of the low-frequency vibration becomes larger due to the weight of this driver's seat and a movement felt by the operator becomes larger. Contrary to this, low-frequency vibration produced in the floor plate can be reduced by the rigidity of the first reinforcement beam by arranging the first reinforcement beam to at least partly overlap the range where the driver's seat is supported as in the above aspect. Further, in the above aspect, the junction tube that can serve as a generation source of the high-frequency vibration is provided on the first reinforcement beam arranged at the position overlapping the position where the driver's seat is supported as described above. Thus, the high-frequency vibration from the junction tube can be reduced by the weight of the driver's seat. Therefore, according to this aspect, noise transmitted to the operator can be effectively reduced by reducing high-frequency vibration while low-frequency vibration is reduced and the floor plate is effectively reinforced.

In the above hydraulic tubing support structure, preferably, each through hole is formed at a position in alignment with the driver's seat in the right-and-left direction or formed behind the position, and a second reinforcement beam extending in the right-and-left direction before the driver's seat and fixed to the lower surface of the floor plate is further provided.

According to this aspect, vibration of the floor plate not only in the range below the driver's seat, but also at the front side of the driver's seat, i.e. on the feet of the operator can be suppressed by providing the second reinforcement beam before the driver's seat. Thus, noise transmitted to the operator can be more effectively reduced. In addition, the junction tube is fixed to the first reinforcement beam rearward provided closer to the respective through holes than the second reinforcement beam. Thus, as compared with the case where the junction tube is fixed to the second reinforcement beam, the pump-side tubes and the tank-side tubes extending from the junction tube to be connected to the respective operation valves via the respective through holes can be shortened. Therefore, according to the above aspect, noise transmitted to the operator can be effectively reduced while the pump-side tubes and the tank-side tubes are shortened.

In the above hydraulic tubing support structure, preferably, a supporting member fixed to the upper surface of the floor plate and adapted to support the driver's seat is further provided, and the supporting member is a hollow member.

According to this aspect, since the supporting member for supporting the driver's seat is a hollow member, high-frequency vibration from the junction tube can be trapped in the interior space of this supporting member. This can suppress the transmission of this high-frequency vibration as noise to the operator sitting on the driver's seat.

In the above hydraulic tubing support structure, preferably, the first reinforcement beam includes a main body portion extending in the right-and-left direction and a pair of front and rear leg portions standing on this main body portion, upper end parts of the respective leg portions being welded to the lower surface of the floor plate to form a clearance between the main body portion and the floor plate, the main body portion is formed with an internally threaded portion with which a bolt is threadably engageable from below the main body portion, and the junction tube is fixed to the first reinforcement beam by the bolt threadably engaged with the internally threaded portion of the main body portion.

According to this aspect, the junction tube can be fixed by the bolt to the first reinforcement beam fixed to the floor plate by welding by forming the internally threaded portion utilizing the clearance between the floor plate and the main body portion. Thus, the junction tube can be fixed without specially working the floor plate.

The above hydraulic tubing support structure preferably further includes a third reinforcement beam extending in the right-and-left direction and fixed to the lower surface of the floor plate to pass a position where an amplitude peaks in a natural vibration mode of the floor plate to which the first reinforcement beam is fixed.

According to this aspect, the third reinforcement beam is provided in a part of the floor plate having the first reinforcement beam fixed thereto where the amplitude becomes larger. Thus, vibration produced in the floor plate can be more effectively reduced by the rigidity of this third reinforcement beam.

In the hydraulic tubing support structure, preferably, the junction tube includes a tube main body arranged between the pair of left and right through holes, a pair of right connecting portions for connection to the pump-side tube and the tank-side tube passing through the right through hole and a pair of left connecting portions for connection to the pump-side tube and the tank-side tube passing through the left through hole, the pair of right connecting portions are provided on the tube main body to face rightward, and the pair of left connecting portions are provided on the tube main body to face leftward.

According to this aspect, on the tube main body arranged between the pair of left and right through holes, the pair of right connecting portions for connection to the tubes passing through the right through hole are provided to face rightward and the pair of left connecting portions for connection to the tubes passing through the left through hole are provided to face leftward. This enables distances from the respective through holes to the respective right connecting portions and the respective left connecting portions to be shortened. Thus, the pump-side tubes and the tank-side tubes can be shortened.

In the above hydraulic tubing support structure, preferably, the junction tube further includes a pump-side connecting portion and a tank-side connecting portion for connection to tubes respectively connected to a hydraulic pump and a tank provided behind the tube main body, and the pump-side connecting portion and the tank-side connecting portion are respectively provided on the tube main body to face backward.

According to this aspect, the pump-side connecting portion and the tank-side connecting portion are provided on the tube main body to face backward. This enables distances from the hydraulic pump and the tank provided behind the tube main body to the pump-side connecting portion and the tank-side connecting portion to be shortened. Thus, the tubes connecting the hydraulic pump and the tanks to the junction tube can be shortened.

Further, the present invention provides an operating machine including the above hydraulic tubing support structure and a hydraulic pump and a tank to be connected to the junction tube.

INDUSTRIAL APPLICABILITY

According to the present invention, it is possible to reduce noise transmitted to an operator due to pulsation of hydraulic oil in a junction tube.

REFERENCE SINGS LIST

B bolt
M1 mount mounting portion
N nut
P0 to P2 tube
T0 to T2 tube
1 hydraulic shove (example of operating machine)
10 boom cylinder (example of hydraulic actuator)
11 arm cylinder (example of hydraulic actuator)
12 bucket cylinder (example of hydraulic actuator)
15 floor plate
15*a* front reinforcement beam (second reinforcement beam)
15*b* middle reinforcement beam (first reinforcement beam)
15*c* rear reinforcement beam (third reinforcement beam)
16, 17 remote control valve (operation valve)
22 pilot pump (hydraulic pump)
23 tank
24 junction tube
32*a*, 32*b* through hole
33 main body portion
34 leg portion
35 driver's seat
36 operating lever
37 seat stand (supporting member)

The invention claimed is:

1. A hydraulic tubing support structure in an operating machine including a plurality of hydraulic actuators, comprising:

a floor plate formed with a pair of left and right vertically penetrating through holes;

a driver's seat provided on the floor plate;

a pair of operating levers provided at both left and right sides of the driver's seat;

a pair of left and right operation valves for generating pilot pressures for the plurality of hydraulic actuators in response to an input operation performed on each operating lever;

a pair of left and right pump-side tubes respectively extending from the respective operation valves and guided to below the floor plate through the through holes;

a pair of left and right tank-side tubes respectively extending from the respective operation valves and guided to below the floor plate through the through holes;

a junction tube for allowing communication of the respective pump-side tubes guided to below the floor plate through the through holes and communication of the respective tank-side tubes guided to below the floor plate through the through holes; and a first reinforcement beam extending in a right-and-left direction and fixed to the lower surface of the floor plate, wherein the junction tube is fixed to the first reinforcement beam in a non-contact state with the floor plate, and the junction tube includes a tube main body for connecting the pair of left and right pump-side tubes and the pair of left and right tank-side tubes and a base member attached to the main body and fixed to the first reinforcement beam.

2. A hydraulic tubing support structure according to claim 1, wherein at least a part of the first reinforcement beam is provided at a position overlapping a range of the floor plate where the driver's seat is supported when viewed from above.

3. A hydraulic tubing support structure according to claim 2, wherein:

each through hole is formed at a position in alignment with the driver's seat in the right-and-left direction or formed behind the position; and the hydraulic tubing support structure further comprises a second reinforcement beam extending in the right-and-left direction before the driver's seat and fixed to the lower surface of the floor plate.

4. A hydraulic tubing support structure according to claim 2, further comprising a supporting member fixed to the upper surface of the floor plate and adapted to support the driver's seat, wherein the supporting member is a hollow member.

5. A hydraulic tubing support structure according to claim 1, further comprising:

a mount supporting the floor plate and being arranged at a position away from the first reinforcement beam in a front-and-rear direction;

a third reinforcement beam extending in the right-and-left direction and fixed to the lower surface of the floor plate at a position closer to the mount than to the first reinforcement beam between the mount and the first reinforcement beam in the front-and-rear direction.

6. A hydraulic tubing support structure according to claim 1, wherein:

the junction tube includes a tube main body arranged between the pair of left and right through holes, a pair of right connecting portions for connection to the pump-side tube and the tank-side tube passing through the right through hole and a pair of left connecting portions for connection to the pump-side tube and the tank-side tube passing through the left through hole; and the pair of right connecting portions are provided on the tube main body to face rightward and the pair of left connecting portions are provided on the tube main body to face leftward.

7. A hydraulic tubing support structure according to claim 6, wherein:

the junction tube further includes a pump-side connecting portion and a tank-side connecting portion for connection to tubes respectively connected to a hydraulic pump and a tank provided behind the tube main body; and the pump-side connecting portion and the tank-side connecting portion are respectively provided on the tube main body to face backward.

8. An operating machine, comprising:

a hydraulic tubing support structure according to claim 1; and a hydraulic pump and a tank to be connected to the junction tube.

9. A hydraulic tubing support structure in an operating machine including a plurality of hydraulic actuators, comprising:

a floor plate formed with a pair of left and right vertically penetrating through holes;

a driver's seat provided on the floor plate;

a pair of operating levers provide at both left and right sides of the driver's seat;

a pair of left and right operation valves for generating pilot pressures for the plurality of hydraulic actuators in response to an input operation performed on each operating lever;

a pair of left and right pump-side tubes respectively extending from the respective operation valves and guided to below the floor plate through the through holes;

a pair of left and right tank-side tubes respectively extending from the respective operation valves and guided to below the floor plate through the through holes;

a junction tube for allowing communication of the respective pump-side tubes guided to below the floor plate through the through holes and communication of the respective tank-side tubes guided to below the floor plate through the through holes; and a first reinforcement beam extending in a right-and-left direction and fixed to the lower surface of the floor plate, wherein:

the junction tube is fixed to the first reinforcement beam in a non-contact state with the floor plate;

the first reinforcement beam includes a main body portion extending in the right-and-left direction and a pair of front and rear leg portions standing on this main body portion, upper end parts of the respective leg portions being welded to the lower surface of the floor plate to form a clearance between the main body portion and the floor plate;

the main body portion is formed with an internally threaded portion with which a bolt is threadably engageable from below the main body portion; and the junction tube is fixed to the first reinforcement beam by the bolt threadably engaged with the internally threaded portion of the main body portion.

* * * * *